US006373197B1

(12) United States Patent
Chang

(10) Patent No.: US 6,373,197 B1
(45) Date of Patent: Apr. 16, 2002

(54) CONTROLLER FOR FLASH LAMPS SHARING A COMMON POWER SOURCE AND CONTROLLING METHOD THEREOF

(76) Inventor: Ming-Cheng Chang, No. 10, Alley 48, Lane 5, Sheng Li Street, Yung Kang, Tainan Hsien (TW)

( * ) Notice: Subject to any disclaimer, the term of this patent is extended or adjusted under 35 U.S.C. 154(b) by 0 days.

(21) Appl. No.: 09/803,276

(22) Filed: Mar. 9, 2001

(51) Int. Cl.[7] ..... H05B 37/00
(52) U.S. Cl. ..... 315/241 S; 315/294; 315/241 P
(58) Field of Search ..... 315/241 P, 241 S, 315/201, 323, 228–232, 200 A, 294; 340/468, 471, 472, 331

(56) References Cited

U.S. PATENT DOCUMENTS 4,945,279 A * 7/1990 Leu ..... 315/201
5,192,895 A * 3/1993 Chang ..... 315/201
5,341,069 A * 8/1994 Kosich et al. ..... 315/241 S
5,583,397 A * 12/1996 Ogawa ..... 315/151
5,621,379 A * 4/1997 Collins ..... 340/332
5,644,291 A * 7/1997 Jozwik ..... 340/472
5,886,620 A * 3/1999 Stewart et al. ..... 340/332

* cited by examiner

*Primary Examiner*—Don Wong
*Assistant Examiner*—Ephrem Alemu
(74) *Attorney, Agent, or Firm*—Eric K. Satermo

(57) ABSTRACT

A controller is provided for several sets of flash lamps that shares a common power source. The controller comprises a high-voltage charging/discharging circuit and several sets of flashing circuits that shares the high-voltage charging/discharging circuit. The high-voltage charging/discharging circuit is a voltage-increasing loop. comprising two diodes, two capacitors, and a choke coil. Each flashing circuit is a self-activating flashing circuit comprising a resistive-capacitor charging circuit, an activating coil, a silicon controlled rectifier, and a flash lamp. Each set of flashing circuit includes a power source end that is electrically connected to an output end of the high-voltage charging/discharging circuit.

8 Claims, 3 Drawing Sheets

CONTROLLER FOR FLASH LAMPS SHARING A COMMON POWER SOURCE AND CONTROLLING METHOD THEREOF

BACKGROUND OF THE INVENTION

1. Field of the Invention

The present invention relates to a controller for a plurality of sets of flash lamps sharing a common power source. The present invention also relates to a method for controlling selective discharge of the flash lamps.

2. Description of the Related Art

Flash lamps have been widely used in, e.g., photographing, alarm, advertisement, stage performance, or decoration. For stage performance or advertisement, as illustrated in FIG. 3 of the drawings, several identical and individual sets of flash lamps are used. Each set of flash lamps consists of a high-voltage charging/discharging circuit 50 and a flashing circuit 60. The high-voltage charging/discharging circuit 50 comprises two diodes 51 and 52, two capacitors 53 and 54, and a choke coil 55 for supplying the flashing circuit 60 with high-voltage power. The flashing circuit 60 comprises a flash lamp 61, an activating coil 66, a resistor 64, a capacitor 65, a silicon controlled rectifier 63, and a neon lamp 62. A timed self-activating flashing effect is provided by using the characteristic of conduction of the neon lamp 62 only when a pre-determined voltage is reached and the delay characteristic provided by the resistor 64 while charging the capacitor 65. Namely, variable flashing effects can be obtained by setting the resistive-capacitor time constants of all of the sets of flash lamps to be slightly different from each other or in a pre-determined manner.

However, every set of flash lamps requires an independent high-voltage charging/discharging circuit 50. The overall device occupies a considerable space and the efficiency is poor, for the flash lamps do not illuminate continuously. Instead, the flash lamps merely provide brief, momentary flashing. More particularly, most of time, the high-voltage charging/discharging circuit is charged and thus ready for discharging. Namely, the efficiency of use of each high-voltage charging/discharging circuit 50 is very low.

SUMMARY OF THE INVENTION

It is an object of the present invention to provide a controller for a plurality of sets of flash lamps that share a common power source. The controller comprises only one high-voltage charging/discharging circuit and a plurality of flashing circuits that share the high-voltage charging/discharging circuit. The volume of the overall device can be reduced by 40% and the overall cost is also reduced.

It is another object of the present invention to provide a controller for a plurality of sets of flash lamps that share a common power source, wherein irregular self-activating type flash lamp sets can be obtained if each set of flash lamps is set to be in a mode that the neon lamp controls the self-activating flashing circuit by means of using a single high-voltage charging/discharging circuit.

It is a further object of the present invention to provide a controller for a plurality of sets of flash lamps that share a common power source, wherein program-controlled self-activating type flash lamp sets can be obtained by means of using a single high-voltage charging/discharging circuit that cooperates with a programmable controller and providing a signal decoder in each flashing circuit.

It is still another object of the present invention to provide a method for controlling a plurality of sets of flash lamps that share a common power source, the method comprising the steps of:

(a) providing a high-voltage charging/discharging circuit, the high-voltage charging/discharging circuit being a voltage-increasing loop comprising two diodes, two capacitors, and a choke coil;

(b) providing a plurality of sets of flashing circuits, each said set of flashing circuit being a self-activating flashing circuit comprising a resistive-capacitor charging circuit, an activating coil, a silicon controlled rectifier, and a flash lamp, each said set of flashing circuit including a power source end that is electrically connected to an output end of the high-voltage charging/discharging circuit; and (c) selectively discharging the plurality of sets of flashing circuits by the high-voltage charging/discharging circuit under time-sharing control.

In accordance with the present invention, a controller is provided for a plurality of sets of flash lamps that shares a common power source, the controller comprising:

a high-voltage charging/discharging circuit, the high-voltage charging/discharging circuit being a voltage-increasing loop comprising two diodes, two capacitors, and a choke coil; and a plurality of sets of flashing circuits, each said set of flashing circuit being a self-activating flashing circuit comprising a resistive-capacitor charging circuit, an activating coil, a silicon controlled rectifier, and a flash lamp, each said set of flashing circuit including a power source end that is electrically connected to an output end of the high-voltage charging/discharging circuit.

Each flashing circuit includes a neon lamp mounted to the input end thereof, thereby forming a controller for irregular self-activating type flash lamp sets.

In an alternative embodiment, each flashing circuit includes a decoder mounted to the input end thereof, thereby forming a controller for program-controlled self-activating type flash lamp sets. A programmable controller outputs a signal for each flashing circuit. A direct current stabilizing circuit has an output end connected to the programmable controller and each flashing circuit.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
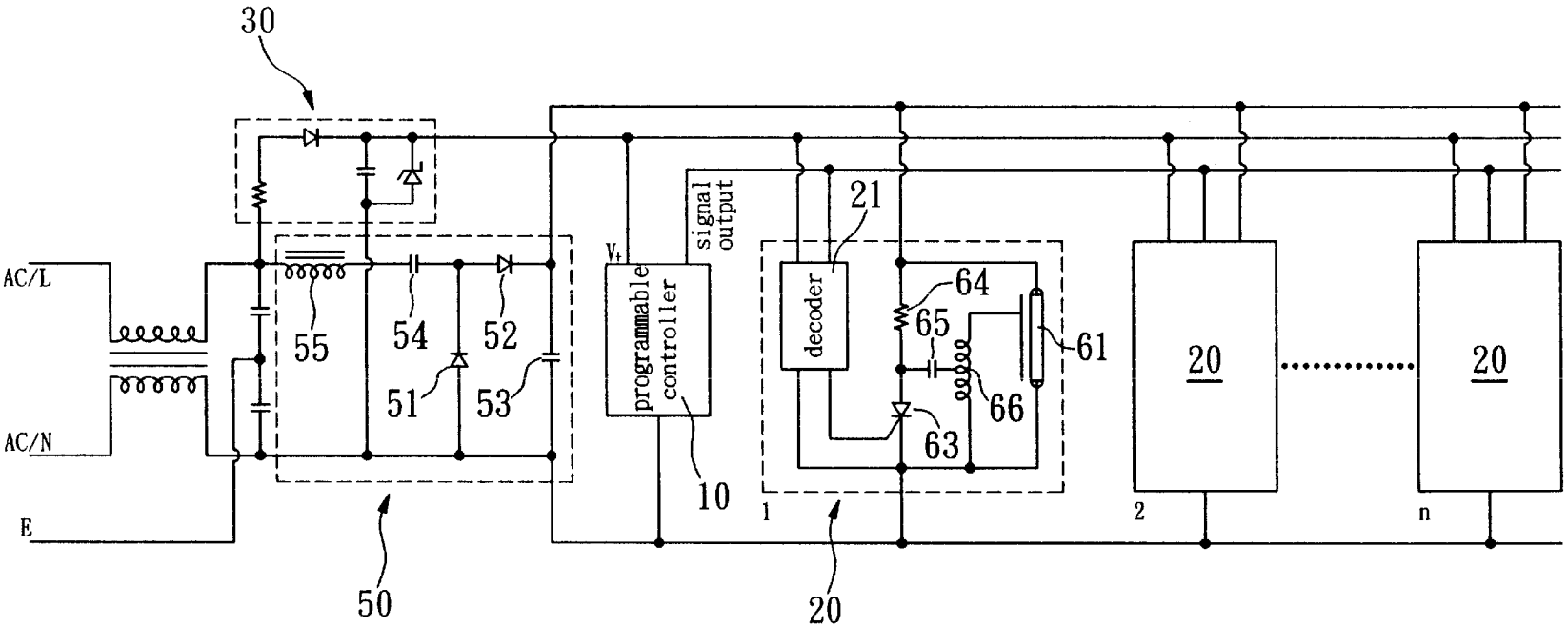
FIG. 1 is a circuit diagram of a controller for program-controlled self-activating type flash lamp sets in accordance with the present invention.
Figure 2:
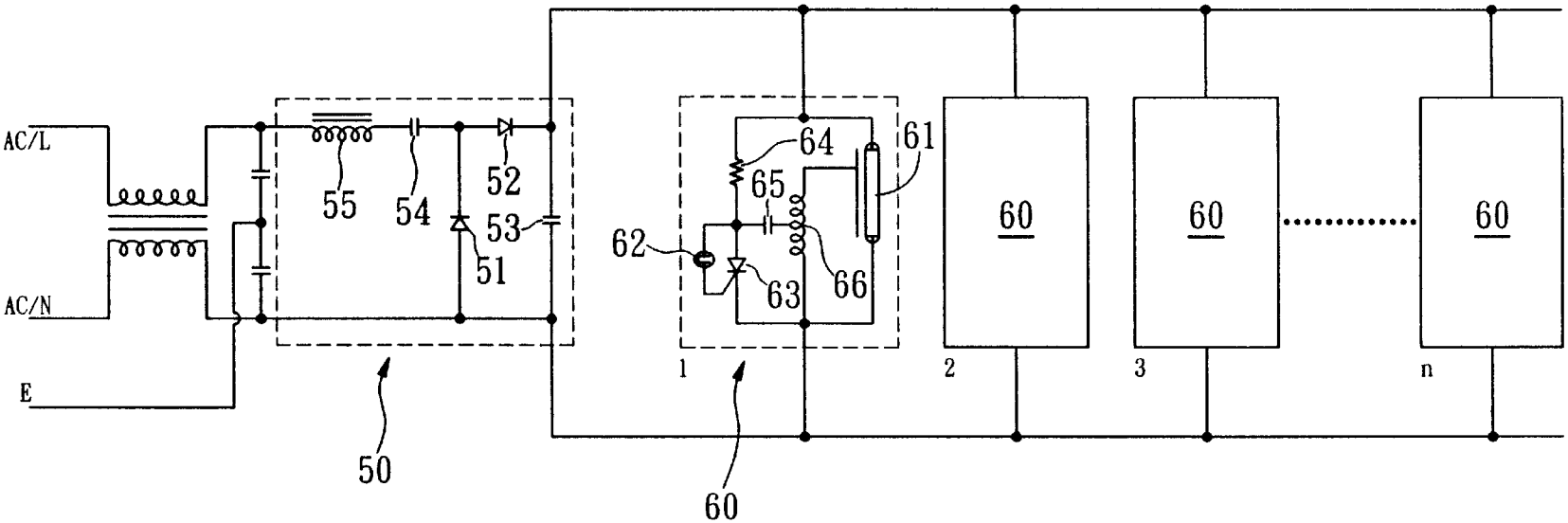
FIG. 2 is a circuit diagram of a controller for irregular self-activating type flash lamp sets in accordance with the present invention.
Figure 3:
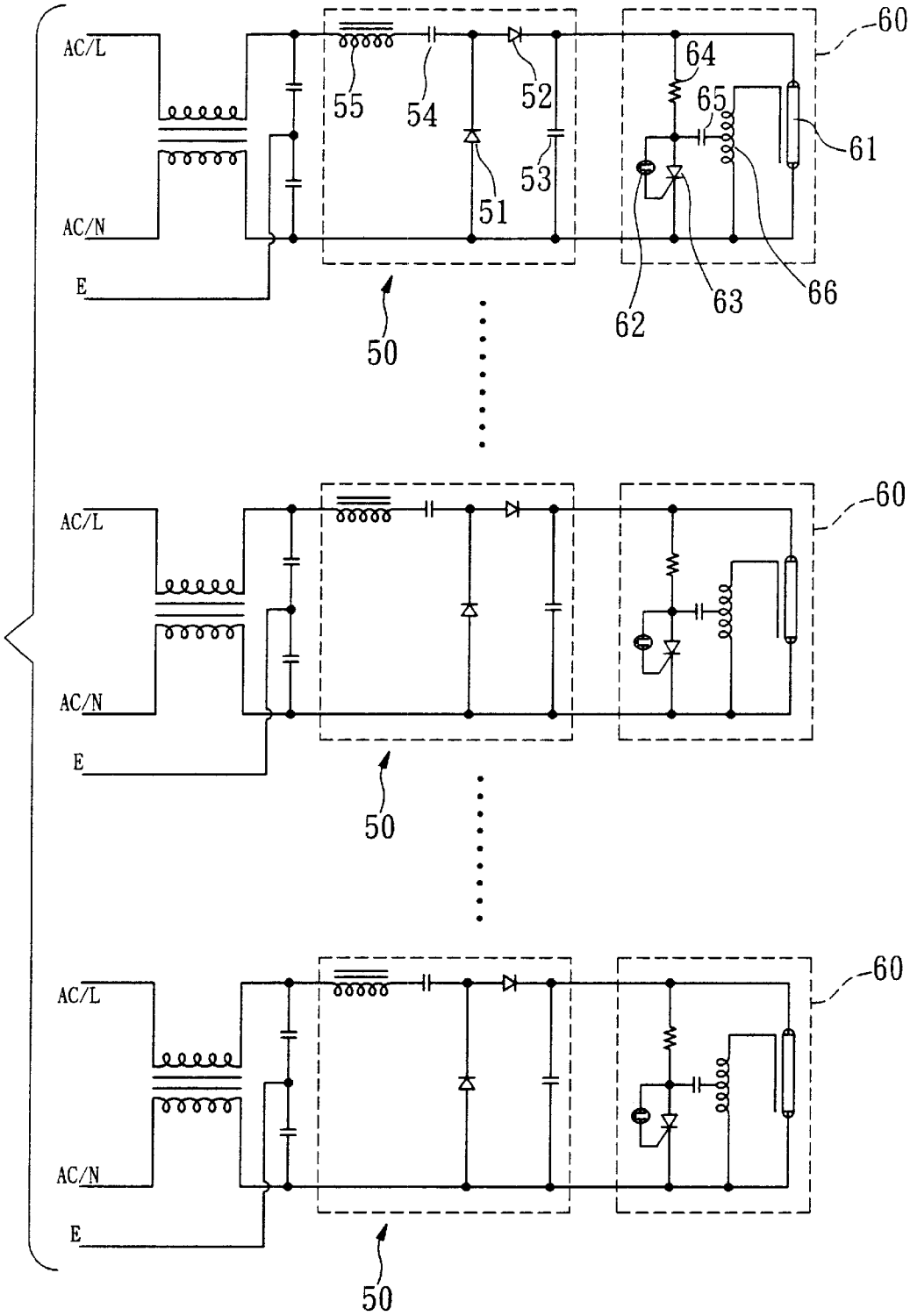
FIG. 3 PRIOR ART
FIG. 3 is a circuit diagram for conventional irregular self-activating type flash lamp sets.

Referring to FIGS. 1 and 2, a controller for a plurality of sets of flash lamps that shares a common power source in accordance with the present invention generally is characterized by that all of the sets of flashing circuit 20, 60 shares a common high-voltage charging/discharging circuit 50. Namely, it is not necessary to provide each flashing circuit 20, 60 with an independent high-voltage charging/discharging circuit 50. Thus, the overall volume and cost for the device is reduced largely.

In FIG. 1, in order to constitute program-controlled self-activating type flash lamp sets, a rectifying/voltage-stabilizing circuit 30 and a programmable controller 10 are provided. In addition, each flashing circuit 20 has a decoder 21 built therein to thereby provide a programmable flashing circuit 20. The rectifying/voltage-stabilizing circuit 30 provides low-voltage d.c. (direct current) to the programmable controller 10 and the decoder 21 in each flashing circuit 20. The programmable controller 10 outputs signal to an input end of the decoder 21 of each flashing circuit 20. Thus, each flashing circuit 20 can be operated and flash under control by the programmable controller 10.

FIG. 2 shows a controller for irregular self-activating type flash lamp sets. Each flashing circuit 60 uses a conventional structure that employs self-activating flashing under control of a neon lamp. This omits the rectifying/voltage-stabilizing circuit 30, the programmable controller 10, and the decoders 21 in FIG. 1.

By means of the plurality of sets of flash lamps sharing a common high-voltage. charging/discharging circuit 50 in accordance with the present invention, it was found that the device functions well. Since each flashing circuit 20, 60 of the same set of flash lamps does not operate (flash) in the same period, and since the time for charging and discharging is relatively short (less than 20 ms), 60 ms (20 ms×3) are required for lighting three flash lamps at a time by a controller for twelve (12) sets of flash lamps by time-sharing control. The time difference can be ignored when considering the visual persistence. If all of the twelve (12) flash lamps are lighted at the same time, it will take 0.24 ms (20 ms×12). Although there is a delay in vision, the entertaining effect would not be adversely affected.

The plurality of sets of flash lamps sharing a common high-voltage charging/discharging circuit function well. By means of time-sharing control, the electric power for the high-voltage charging/discharging circuit, even under full load, is approximately the same as that for a lamp. Namely, there is no need to use a high-power high-voltage charging/discharging circuit. The efficiency of use of the high-voltage charging/discharging circuit is largely improved. The space and cost for the overall device are also reduced.

In conclusion, the present invention provides a controller for a plurality of sets of flash lamps that shares a common power source, the controller comprising:

- a high-voltage charging/discharging circuit 50, the high-voltage charging/discharging circuit 50 being a voltage-increasing loop comprising two diodes 51 and 52, two capacitors 53 and 54, and a choke coil 55; and
- a plurality of sets of flashing circuits 20, 60, each said set of flashing circuit 20, 60 being a self-activating flashing circuit comprising a resistive-capacitor charging circuit (including elements 64 and 65 or elements 62, 64, and 65), an activating coil 66, a silicon controlled rectifier 64, and a flash lamp 61, each said set of flashing circuit 20, 60 including a power source end that is electrically connected to an output end of the high-voltage charging/discharging circuit 50.

The present invention also provides a method for controlling a plurality of sets of flash lamps that share a common power source, the method comprising the steps of:

(a) providing a high-voltage charging/discharging circuit 50, the high-voltage charging/discharging circuit 50 being a voltage-increasing loop comprising two diodes 51 and 52, two capacitors 53 and 54, and a choke coil 55;

(b) providing a plurality of sets of flashing circuits 20, 60, each said set of flashing circuit 20, 60 being a self-activating flashing circuit comprising a resistive-capacitor charging circuit (including elements 64 and 65 or elements 62, 64, and 65), an activating coil 66, a silicon controlled rectifier 63, and a flash lamp 61, each said set of flashing circuit 20, 60 including a power source end that is electrically connected to an output end of the high-voltage charging/discharging circuit; and (c) selectively discharging the plurality of sets of flashing circuits 20, 60 by the high-voltage charging/discharging circuit 50 under time-sharing control.

Although the invention has been explained in relation to its preferred embodiment, it is to be understood that many other possible modifications and variations can be made without departing from the scope of the invention as hereinafter claimed.

What is claimed is:

1. A controller for a plurality of sets of flash lamps that shares a common power source, the controller comprising:

a high-voltage charging/discharging circuit, the high-voltage charging/discharging circuit being a voltage-increasing loop comprising two diodes, two capacitors, and a choke coil; and a plurality of sets of flashing circuits, each said set of flashing circuit being a self-activating flashing circuit comprising a resistive-capacitor charging circuit, an activating coil, a silicon controlled rectifier, and a flash lamp, each said set of flashing circuit including a power source end that is electrically connected to an output end of the high-voltage charging/discharging circuit;

each said flashing circuit including a decoder mounted to the input end thereof, thereby forming a controller for program-controlled self-activating type flash lamp sets.

2. The controller as claimed in claim 1, wherein each said flashing circuit includes a neon lamp mounted to the input end thereof thereby forming a controller for irregular self-activating type flash lamp sets.

3. The controller as claimed in claim 1, further comprising a programmable controller that outputs a signal for each said flashing circuit.

4. The controller as claimed in claim 3, further comprising a direct current stabilizing circuit having an output end connected to the programmable controller and each said flashing circuit.

5. A method for controlling a plurality of sets of flash lamps that share a common power source, the method comprising the steps of:

(a) providing a high-voltage charging/discharging circuit, the high-voltage charging/discharging circuit being a voltage-increasing loop comprising two diodes, two capacitors, and a choke coil;

(b) providing a plurality of sets of flashing circuits, each said set of flashing circuit being a self-activating flashing circuit comprising a resistive-capacitor charging circuit, an activating coil, a silicon controlled rectifier, and a flash lamp, each said set of flashing circuit including a power source end that is electrically connected to an output end of the high-voltage charging/discharging circuit; and (c) selectively discharging the plurality of sets of flashing circuits by the high-voltage charging/discharging circuit under time-sharing control;

each said flashing circuit including a decoder mounted to the input end thereof, thereby forming a controller for program-controlled self-activating type flash lamp sets.

6. The method as claimed in claim 5, wherein each said flashing circuit includes a neon lamp mounted to the input end thereof, thereby forming a controller for irregular self-activating type flash lamp sets.

7. The controller as claimed in claim 5, further comprising a programmable controller that outputs a signal for each said flashing circuit.

8. The controller as claim 7, further comprising a direct current stabilizing circuit having an output end connected to the programmable controller and each said flashing circuit.

* * * * *